US005203722A

United States Patent [19]

Kinoshita

[11] Patent Number: 5,203,722

[45] Date of Patent: Apr. 20, 1993

[54] DOUBLE-LOCK ELECTRICAL CONNECTOR

[75] Inventor: Yoshiji Kinoshita, Isehara, Japan

[73] Assignee: AMP Incorporated, Harrisburg, Pa.

[21] Appl. No.: 946,241

[22] Filed: Sep. 17, 1992

Related U.S. Application Data

[63] Continuation of Ser. No. 758,042, Sep. 12, 1991, abandoned.

[30] Foreign Application Priority Data

Sep. 28, 1990 [JP] Japan ..... 2-257519

[51] Int. Cl.[5] ..... H01R 13/40

[52] U.S. Cl. ..... 439/595; 439/752

[58] Field of Search ..... 439/595, 752, 599, 603, 439/742, 746, 871, 872, 873

[56] References Cited

U.S. PATENT DOCUMENTS

| | | | |
|---|---|---|---|
| 4,621,883 | 11/1986 | Noguchi | 439/752 X |
| 4,721,478 | 1/1988 | Sonobe | 439/752 X |
| 4,867,711 | 9/1989 | Yuasa | 439/752 |
| 5,017,163 | 5/1991 | Ohsumi | 439/752 |
| 5,071,373 | 12/1991 | Nagasaka et al. | 439/752 |

FOREIGN PATENT DOCUMENTS

| | | |
|---|---|---|
| 55-92284 | 6/1980 | Japan . |
| 63-32876 | 2/1988 | Japan . |
| 1-54677 | 3/1989 | Japan . |
| 1-54678 | 3/1989 | Japan . |
| 1-60474 | 4/1989 | Japan . |
| 1-64872 | 4/1989 | Japan . |
| 1-43986 | 9/1989 | Japan . |

*Primary Examiner*—Larry I. Schwartz
*Assistant Examiner*—Khiem Nguyen
*Attorney, Agent, or Firm*—Adrian J. LaRue; Timothy J. Aberle

[57] ABSTRACT

An electrical connector (20,60) includes rows of chambers (36) into which contacts (26) are held seated in place in such chambers through internal lances (58) and a double-locking device (24) inserted through an opening (40) in a wall of the housing (22) of the connector. The locking device (24) includes latches (52) which cooperatively engage depressions (50) to establish a first locking position allowing contact insertion and further latches (56) which engage interior walls (54) to establish a second locking position upon final insertion of the device (24) into the housing (22). Improper contact insertion and seating precludes operation of the locking device (24) as a visible indication of improper insertion. Proper insertion of locking device (24) assures a double-locking against contact backout and provides primary and secondary retention of contacts in the connector.

4 Claims, 4 Drawing Sheets

DOUBLE-LOCK ELECTRICAL CONNECTOR

This application is a continuation of application Ser. No. 07/758,042 filed Sep. 12, 1991, now abandoned.

This invention relates to an electrical connector including a double-lock to prevent contact backout.

BACKGROUND OF THE INVENTION

Electrical connectors designed to provide a reliable and secure contact retention, to preclude contact backout of connector housings are in wide use at this time. Such uses include particularly vehicular electrical systems where vibration and road shocks have been known to cause contact backout and electrical system failure. The prior devices typically include insulating housings equipped with lances protruding from the internal walls of the housing into the contact receiving chambers and additionally a double-lock device made of plastic which is inserted through a side wall of the housing to block contact backout. An example of a double-lock prior art publication wherein the locking operates by engaging the rear end of a contact may be found in Japanese publication No. HEI 1 (1989)-43986. An alternative retention of contacts is taught in Japanese publication No. HEI 1 (1989)-64872, wherein the insulating housing is arranged to clamp the contacts.

In yet a further alternative as taught in Japanese publication SHO64 (1989)-54678 and depicted as prior art in FIGS. 6 and 7 of this application, a double-lock device 13 is inserted into a wall la of an insulating housing 1. The double-lock device 15 has member 13 and projections 8 which fit into openings 6 of housing 1. Retention lugs 9 are on member 13 and lugs 10 are on the projections 8 and member 13, as shown in FIG. 6. Projections 10 fit within notches in a contact 3 in the side thereof and preclude withdrawal of the contacts or displacement and backout. Lugs 9, 9' latch device 15 into housing 1 as shown in FIG. 7. As also shown in FIG. 7 the referred to prior art contact 3 includes a latch 5 which latches internally of the housing and is one part of the double-lock system of retention.

Problems with prior art double-lock devices such as those referred to include tolerance variations in housings and contacts which result in an incomplete insertion of the contacts which can allow backout despite the double-lock features. Another problem relates to the use of spring elements on contacts which may be deflected inelastically to preclude functioning in holding the contacts in position during the insertion of double-lock devices in the housing. With respect to multi-way connectors, the need to fully insert all contacts prior to insertion of the double-locking device may be frustrated if a single contact is not fully seated. Still a further problem has to do with connectors which require more than two rows of chambers and contacts and particularly with those wherein the chambers and contacts are required to be staggered for the purposes of improved density or layout considerations.

Accordingly it is an object of the present invention to provide an electrical connector having double-lock features precluding contact backout which relate to improved reliability, ease of use and adaptation to connectors having more than two rows of chambers and contacts. It is still a further object to provide a double-locking electrical connector which allows the locking device to be retained in the connector prior to and during insertion of contacts and then activated further to effect the double-locking function.

SUMMARY OF THE INVENTION

The present invention achieves the foregoing objectives by the provision of an insulating housing with a number of chambers extending through the housing to receive a number of contacts inserted therein and with an opening in a wall of the housing extending across the housing and intersecting the chambers and paths of insertion of the contacts. The invention includes a double-lock device in the form of a plastic element having apertures and reliefs therein which can be inserted in the opening in a first position of alignment allowing insertion of contacts into the housing and through the locking device and a second position wherein edge surfaces of the locking device engage edge surfaces of contacts to preclude contact backout. The housing includes plastic latch elements internally which engage the contacts and provide a primary retention holding the contacts in place in the housing and the double-lock device when activated serves as a secondary retention against contact backout. The locking device includes projections which engage interior surfaces of the housing to provide the first and second positions in the opening of the housing to allow contact insertion and provide secondary retention. The contacts of the invention include rigid edge surfaces which are engaged by edge surfaces of the locking device to minimize problems with tolerance variation or inelastic deformation of spring elements and the like.

IN THE DRAWINGS

DETAILED DESCRIPTION OF THE INVENTION

Figure 1:
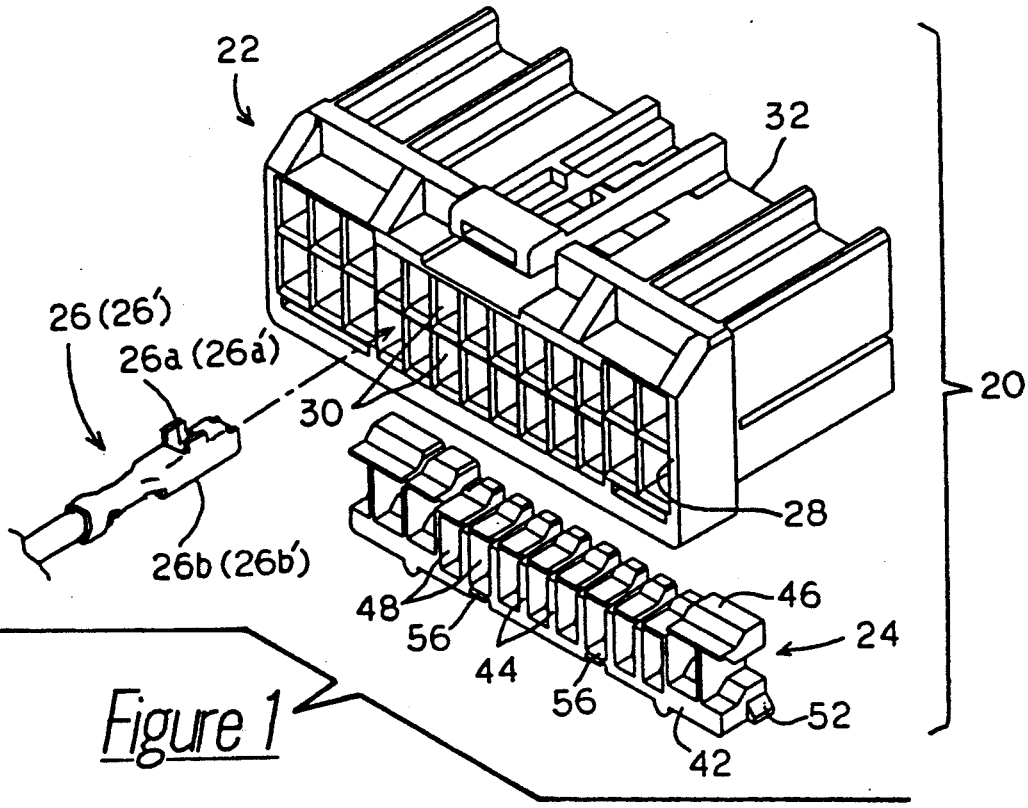
FIG 1 is a perspective of the invention connector showing the double-locking device removed therefrom and a contact positioned prior to insertion in the connector housing.
Figure 2:
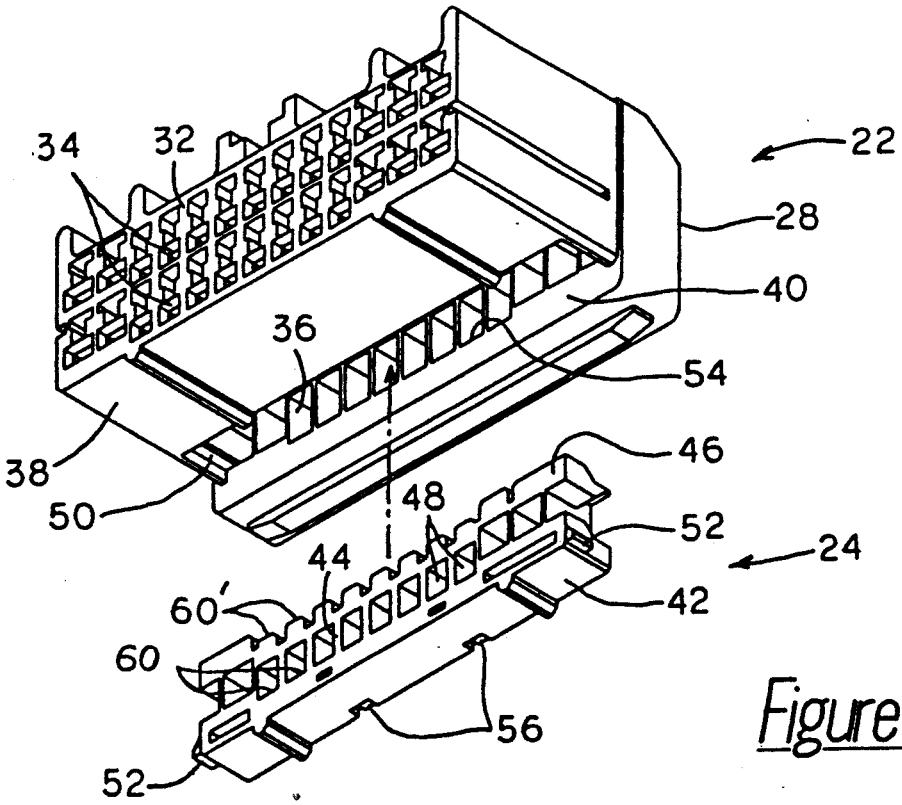
FIG. 2 is a perspective of the housing and double-locking device shown in FIG. 1, from the underside thereof.

FIGS. 1 and 2 represent perspective exploded views from two directions, upper and lower, of an embodiment of an electrical connector of the double-lock type in accordance with the present invention. The elements are shown disassembled. As can be discerned from these figures a connector 20 consists of an insulating housing 22, a double-lock device 24 and a contact 26 which is representative of the multiple contacts accommodated by housing 22. FIG. 1 shows the contact insertion side 28 of housing 22 and a number of openings 30 into which contacts 26 are inserted. FIG. 2 shows the reverse side 32 of housing 22 with a series of openings 34. The connector housing 22 is adapted to mate with a matching connector half not shown in the figures, the openings 34 adapted to receive contacts which mate with contacts 26 inside the housing 22. As can be discerned both sets of openings 30 and 34 are arranged in two rows. The openings 30 and 34 lead to contact receiving chambers 36 in which the contacts 26 are fitted in the manner shown FIGS. 3 and 4. The side of housing 22, side 38, is shown in FIG. 2 to include a large opening 40 which accommodates the double-lock device 24 inserted therewithin. The opening 40 is made in such a way that it intersects the contact receiving chambers 36. The double-lock device 24 is typically made of a synthetic plastic resin, of insulating characteristics. It has a continuous base 42 in its longitudinal direction, from which extend partitions 44 which are spaced out at certain intervals. The ends of the partitions 44 are connected to portions 46 which are interconnected in turn, so as to form the contact openings 48, arranged in a single row.

Figure 3:
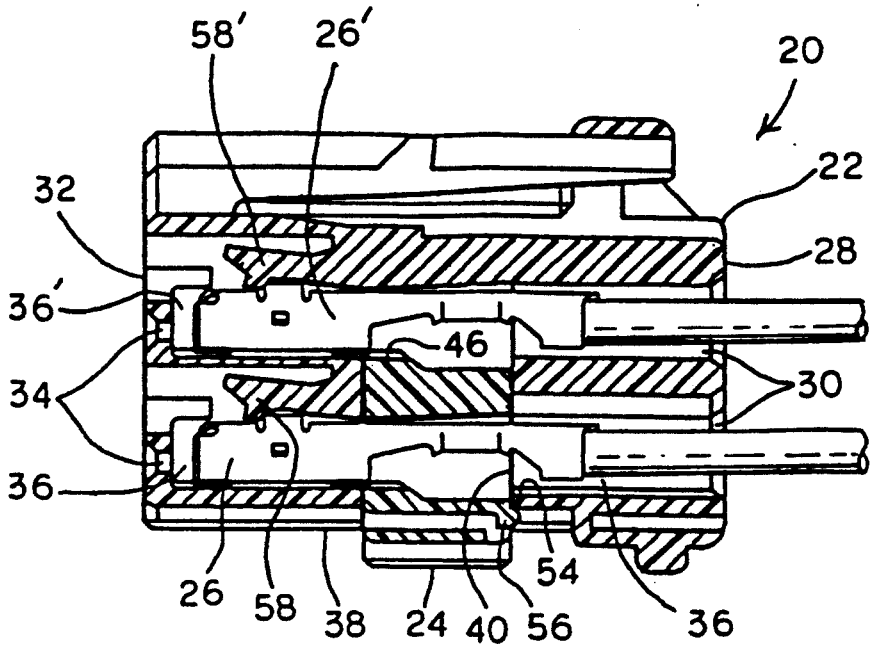
FIG. 3 is a side and partially sectioned view of the connector of the invention showing the housing with the double-locking device in a first latched position therein and with contacts inserted in such housing.

In a prelocked position of the double-lock device 24 as shown in FIG. 3, the contact openings 48 line up with the lower row of the contact receiving chambers 36 of the insulating housing 22. At both ends of the base 42 of the double-lock device 24 are lugs or projections 52 which can be seen in FIGS. 1 and 2. These projections serve to provide a first locking step during insertion of the locking device 24 through engagement of projections 52 with depressions 50 in housing 22, one of which is shown in FIG. 2. On the back end of base 42 are provided stopping lugs or projections 56 of the second locking step, which lock into the internal wall 54 of the contact receiving chambers 36 of the housing 22, as shown in FIG. 4.

FIG. 3 shows in cross-section the double-lock device 24 inserted in the first locking step position allowing insertion of contacts 26 through the alignment heretofore mentioned with the chambers 36. The locking device 24 is held temporarily attached to housing 22 due to the fact that the projections 52 of the first locking step are engaged in the depressions 50 as mentioned. As the contacts are inserted from the position shown in FIG. 3 to the position shown in FIG. 4 lances 58 formed internally of the housing and extending into the chambers engage a notch 26*a* of the contacts 26 in the manner shown in FIG. 4 to latch the contacts forwardly. It is to be understood that until such contacts are seated and the latches 58 are so engaged in notches 26*a* of contacts 26 the locking device 24 cannot be fully engaged. Thus in the position of the contact 26 shown in FIG. 3 it will be discerned that the leading left edge of device 24 will strike the bottom surface 26*b* of contact 26 and preclude full insertion of the device 24.

The lances 58 serve the primary retention feature for the connector 20 and by driving the contacts home to the point of latching the connector can then be manipulated to insert the device 24 without fear that the contact will become loose and back out. Additionally, as mentioned above, the device 24 cannot be actuated until the contacts are fully seated.

Figure 4:
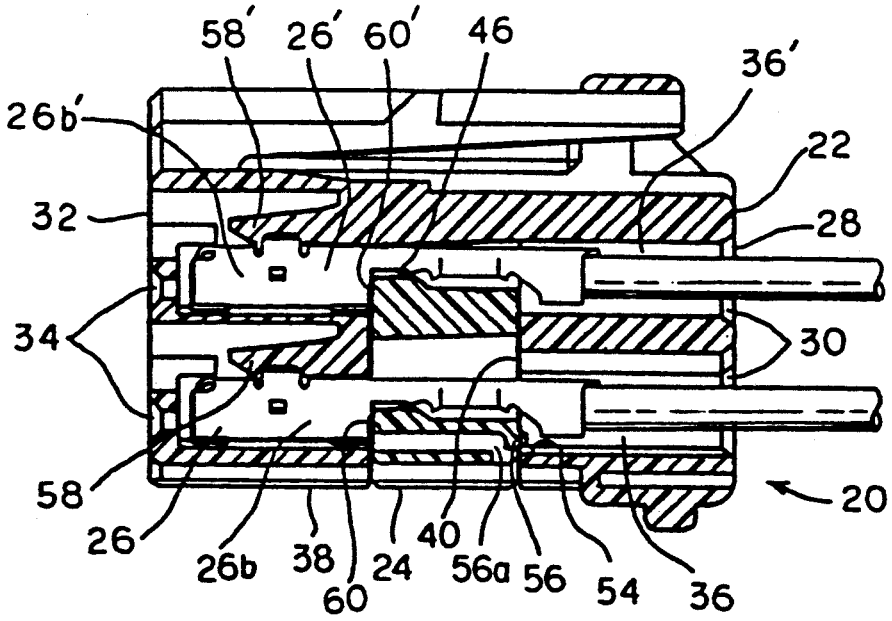
FIG. 4 is a view of the connector shown in FIG. 3 with the double-locking device in a second position.

After all contacts 26 are secured in the connector with the lances 58 in place, the double-lock device 24 is pushed further into the opening 40 where it assumes the position shown in FIG. 4. There the projections 56 of the second locking step engage the internal wall 54 of the lower row of contact receiving chambers 26 of housing 22 and secure the double-lock device 24 in the position shown in housing 22. In this condition the edges 60, 60' of the front end of the double-lock device 24, referring to FIGS. 2–4, are pressed against the back edges of the lower surfaces 26*b* of the contacts 26 to add a second retention and form the second locking step of the connector. The portions 46 of double-lock device 24 are part of a solid piece of plastic material as shown in FIGS. 1 and 2 and cannot be readily bent as in the case with the conventional projections in the prior art heretofore mentioned. This will cause a stubbing of portion 46 against the surface of an incompletely inserted contact as mentioned to assume a positive and readily identified recognition of incompletely inserted contacts.

Should removal of the double-lock device 24 be desired a screwdriver pressed into the opening 56*a* situated next to the projection 56 will allow deflection of the plastic parts and removal of the locking device from the position shown in FIG. 4 to the position shown in FIG. 3 and, thereafter, allow removal of the contacts by manipulating the lances 58 through the front openings 34 with a screwdriver or other blade tool. The invention contemplates a second locking step which is not limited to an engagement of the back end of the contact but rather against any back surface of the contact or in other locations which do not lead to a variation in the dimensions after locking has taken place.

Figure 5:
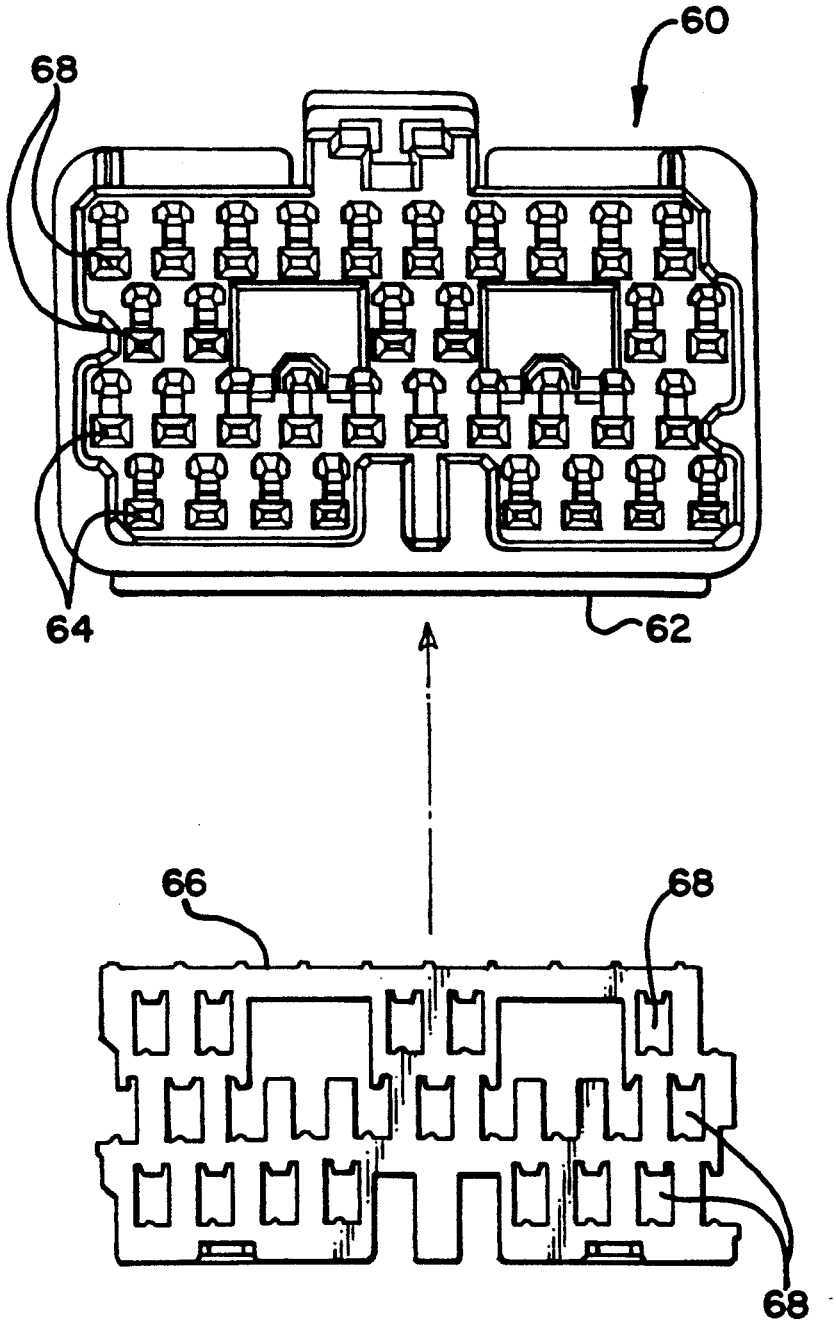
FIG. 5 is an elevational view of an alternative embodiment of connector housing and double-locking device shown in elevation.
Figure 6:
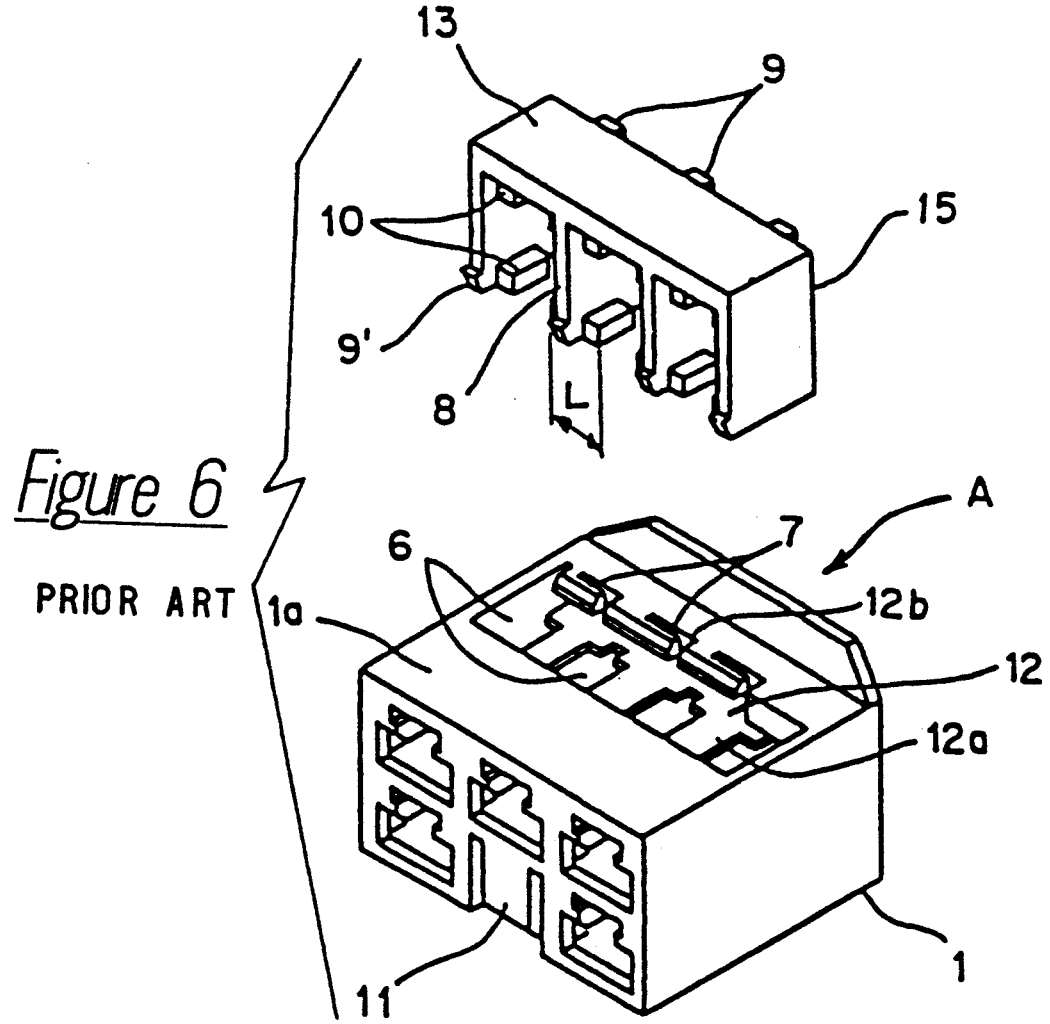
Figure 6 PRIOR ART
FIGS. 6 and 7 are views of a prior art connector.
Figure 7:
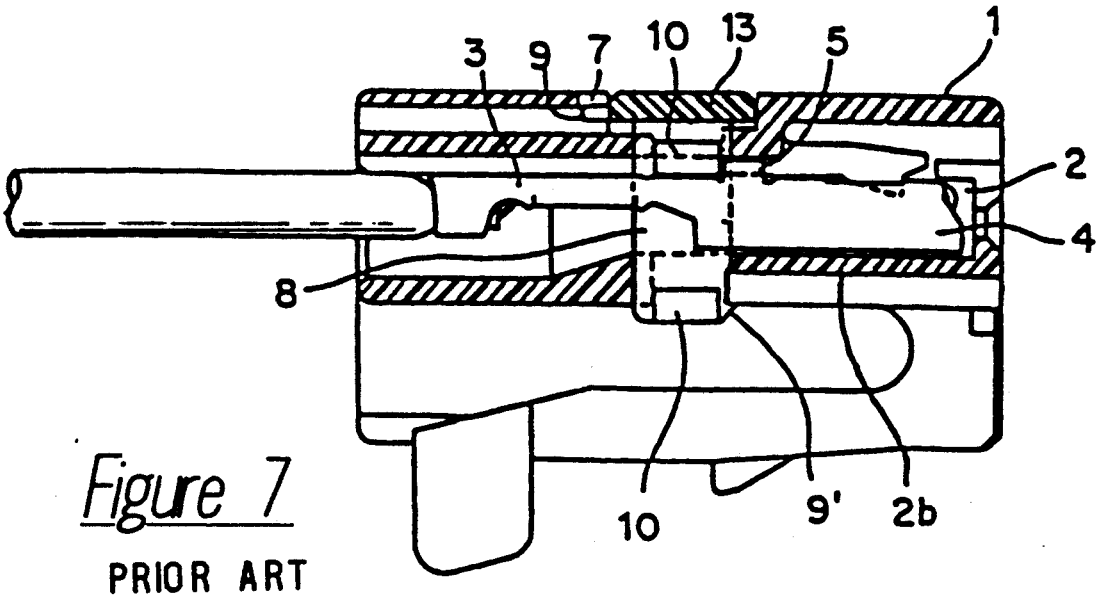
Figure 7 PRIOR ART

FIG. 5 is a view of an alternative embodiment of the double-lock electrical connector in accordance with the invention. In FIG. 5 a connector 60 of an alternative construction is shown to have a housing 62 containing openings 64 through which contacts of a matching connector half (not shown) are inserted. The openings 64 are arranged in a four row and zig-zag pattern and join contact receiving chambers not shown but essentially similar to those shown with respect to FIGS. 1–4. A double-locking device 66 is included which has openings 68 for contacts to pass through and these openings correspond to three of the rows of contact insertion opening 64 and are also arranged in a matching zig-zag pattern. The double-locking device 66 is inserted into housing 62 through an opening not shown but arranged across the housing 62 in the manner described with respect to the previous embodiment. As can be appreciated with respect to prior art double-lock devices like that shown in FIGS. 6 and 7 an arrangement of rows of apertures which are staggered or in a zig-zag pattern could not be readily done with the locking device shown in FIG. 6.

Having now described the invention in terms intended to enable a preferred practice thereof claims are appended and intended to define the invention;

I claim:

1. An electrical connector housing, comprising:

a dielectric housing member having at least one row of contact-receiving chambers extending from a contact-receiving end to a front end for receiving electrical contacts terminated to wires therein, said housing member positioned inwardly approximately midway between said insertion end and said front end and intersecting said contact-receiving chambers;

first latching surfaces provided by said contact-receiving chambers adjacent the opening in said wall;

second latching surfaces provided by said contact-receiving chambers adjacent the opening in said wall;

a dielectric locking member profiled to fit within said opening and having holes including edge surfaces therethrough;

first latching means on said locking member engagable with said first latching surfaces when said locking member is inserted within said opening to maintain said locking member at a first position thereby aligning said holes of said locking member with said contact-receiving chambers so that electrical contacts can be inserted within the contact-receiving chambers; and second latching means on said locking member engagable with said second latching surfaces when said locking member is moved further into said opening to maintain said locking member at a second position so that edge surfaces of said holes of said locking member engage the electrical contacts positioned in the contact-receiving chambers at a point removed from the point of wire termination to prevent backing out of the contacts therefrom due to wire strain.

2. An electrical connector housing as claimed in claim 1, wherein said housing member includes integral lance members extending along said contact-receiving chambers for engaging the electrical contacts upon proper positioning of the contacts in the contact-receiving chambers thereby latching the contacts in place as a primary means of retention of the contacts in the contact-receiving chambers.

3. An electrical connector housing as claimed in claim 1, wherein said housing member has at least a further row of contact-receiving chambers; said locking member having projections in alignment with said holes and corresponding in number to that of the contact-receiving chambers of the further row thereof; said projections being in a first position when said locking member is at said first position so that electrical contacts can be inserted into the further row of contact-receiving chambers and being in a second position engaging the contacts in the further row of contact-receiving chambers to prevent backing out of the contacts therefrom when the locking member is at the second position.

4. An electrical connector housing, comprising:

a dielectric housing member having at least one row of contact receiving chambers receiving contacts terminated to wires extending from a contact-insertion end to a front end for receiving electrical contacts therein, said housing member having an opening in a wall of said hosing member positioned inwardly approximately midway between the insertion end and the forward end of said housing and intersecting said contact-receiving chambers;

a dielectric locking member profiled to fit within said opening and having holes therethrough, including edge surfaces;

first latching means providing by ends of said locking member and opposing surfaces of the opening of said housing member when said locking member is inserted within said opening to maintain said locking member at a first position thereby aligning said holes of said locking member with said contact-receiving chambers so that electrical contacts can be inserted within the contact-receiving chambers; and second latching means provided along a side of said locking member and edges of the contact-receiving chambers to maintain said locking member at a second position within said opening so that the edge surfaces of said locking member adjacent said holes thereof engage the electrical contacts positioned in the contact-receiving chambers at a point removed from wire termination to prevent backing out of the contacts therefrom due to wire strains.

* * * * *